United States Patent [19]

Nicholson

[11] 4,184,415

[45] Jan. 22, 1980

[54] AIR CIRCULATION APPARATUS

[75] Inventor: Dick H. Nicholson, Gas City, Ind.

[73] Assignee: General Connector Corporation, Markle, Ind.

[21] Appl. No.: 924,498

[22] Filed: Jul. 14, 1978

[51] Int. Cl.[2] ..... F24F 7/06

[52] U.S. Cl. ..... 98/33 A; 98/33 R; 236/49; 211/86

[58] Field of Search ..... 98/33 A, 33 R; 211/86; 236/49

[56] References Cited

U.S. PATENT DOCUMENTS

| | | | |
|---|---|---|---|
| 1,170,551 | 2/1916 | Marty | 98/33 A |
| 2,173,073 | 9/1939 | Pierson | 126/110 B |
| 2,532,737 | 12/1950 | Simpson | 98/40 D |
| 2,707,526 | 5/1955 | Gordon | 165/57 |
| 2,733,649 | 2/1956 | Barron | 98/33 R |
| 3,173,353 | 3/1965 | Watkins | 98/33 A |
| 3,347,025 | 10/1967 | Wiley | 98/33 A |
| 3,482,503 | 12/1969 | Jenn | 98/33 R |
| 3,750,557 | 8/1973 | Peill et al. | 98/33 A |
| 3,789,747 | 2/1974 | Wasserman et al. | 98/33 A |
| 3,820,694 | 6/1974 | Pabis | 211/86 |
| 3,827,342 | 8/1974 | Hughes | 98/33 A |
| 3,961,822 | 6/1976 | Danniel | 211/86 |
| 3,973,479 | 8/1976 | Whiteley | 98/33 A |
| 4,053,732 | 10/1977 | Carter | 98/33 A |
| 4,101,036 | 7/1978 | Craig | 211/86 |
| 4,136,606 | 1/1979 | Wolbrink | 98/33 A |

FOREIGN PATENT DOCUMENTS

| | | | |
|---|---|---|---|
| 1264725 | 3/1968 | Fed. Rep. of Germany | 98/33 A |
| 2275734 | 1/1976 | France | 98/33 A |
| 7443257 | 7/1976 | France | 98/33 A |
| 2374595 | 8/1978 | France | 98/33 A |

*Primary Examiner*—Henry C. Yuen

*Attorney, Agent, or Firm*—Gust, Irish, Jeffers & Rickert

[57] ABSTRACT

An air circulation apparatus for achieving more uniform temperature conditions throughout the room by drawing cooler air upwardly from the floor level and discharging it near the ceiling. The apparatus comprises a vertical tubular member having an air inlet at its lower end and a plurality of circumferentially spaced air outlets at its upper end, a motor-driven blower in the lower portion of the tubular member and a deflector mounted adjacent the outlets for directing the moving air through the outlets in a lateral direction. The tubular member is frictionally supported between the floor and ceiling by means of a pair of rubber capped poles extending from the upper and lower ends thereof. The upper pole is telescopically received within the tubular member and urged into frictional engagement with the ceiling by means of a compressed spring. If desired, decorative brackets suitable for hanging flower pots or the like may be mounted on the tubular member. A differential thermostatic control circuit may be provided to energize the blower motor.

8 Claims, 4 Drawing Figures

AIR CIRCULATION APPARATUS

BACKGROUND OF THE INVENTION

1. Field of the Invention

The present invention relates to air circulation apparatus, and in particular to apparatus wherein cooler air is drawn upwardly from the lower portion of the room and discharged just below the ceiling so as to force the warmer air in the upper portion of the room downwardly.

2. Description of the Prior Art

The phenomenon whereby warm air in a room rises and colder air descends results in a temperature gradient that decreases heating efficiency and creates drafts which render the room uncomfortable. The reduction in heating efficiency results from the fact that the thermostat is normally located approximately halfway between the floor and ceiling and therefore senses an ambient temperature which is lower than the temperature of the air above the level of the thermostat. To maintain the temperature of the room at the desired level, therefore, the heating plant must raise the temperature of the air within the upper portion of the room at a level higher than that of the comfort setting. The occupants of the room rarely come into contact with this higher temperature air, however, and the energy required to heat it is therefore wasted.

Another undesirable effect of temperature stratification is the loss of heat through the ceiling, especially in the case of a second story rooms. It is a commonly recognized fact that the greatest heat loss during the winter months occurs through the ceiling of the top floor. In most cases, the walls of the attic are not insulated so that the attic temperature is very close to that of the outside ambient. Although there may be insulation in the floor of the attic, it is generally not thick enough to reduce the transmission of heat to an acceptably low level and the ceiling of the second floor therefore acts as a large heat sink. With the warmest air occupying the stratum next to the ceiling, the difference in temperature between the relatively cold attic and the relatively warm room is at a maximum. This condition, in turn causes maximum heat transfer between the interior room and the attic.

In order to avoid the problems discussed above, a number of prior art apparatuses have been proposed whereby air from the upper portion of the room is pumped to the lower portion of the room, or vice versa. One example of such an apparatus is disclosed in U.S. Pat. No. 3,827,342 and comprises a vertical tube having an opening on its upper end and being supported on a base, which includes a plurality of intake passageways. A motor driven blower, which is mounted within the upper portion of the tube, draws cold air from the area near the floor and discharges it through the top opening whereupon it is dispersed by a conical deflector. The deflector also serves as a stabilizer and is urged against the ceiling by means of a coil spring.

A further example of prior art air circulation devices of this general type is shown in U.S. Pat. No. 3,173,353. This patent disclosed a device which is free standing and comprises a plurality of telescoping sections supported on a base, and a motor driven blower within the base which draws ceiling air downwardly and out through a discharge opening in the base. A somewhat similar device is shown in U.S. Pat. No. 3,973,479 in which one fan draws air from the floor level and discharges it at the ceiling level via one flow path, and a second fan draws air in from the ceiling level and discharges it at the floor level via a separate flow path.

SUMMARY OF THE INVENTION

The present invention is characterized by a single vertical tube having an air inlet and motor driven blower at the lower end and a plurality of circumferentially arranged discharge openings at the upper end. A conical deflector, which is mounted within the tubular member at the center of the discharge openings, serves to direct the vertical stream of air out through the discharge openings in lateral directions. The tubular member is supported vertically by means of a pair of rubber capped poles which extend from opposite ends of the tubular member along its longitudinal axis, one of the poles being spring tensioned so that the distal ends of the poles are urged respectively into frictional engagement with the ceiling and floor.

Specifically, the present invention contemplates an air circulating apparatus comprising: an elongated tubular member having an inlet opening in one end and an outlet opening in the other end thereof, a floor pole secured to one end of the tubular member and having a distal end to which is attached a resilient cap adapted frictionally to engage a flat surface, a ceiling pole secured to the other end of the tubular member and including a distal end to which is attached a second resilient end cap adapted frictionally to engage a flat surface, at least one of the poles being extensibly connected to the tubular member for rectilinear movement along a direction generally collinear with the longitudinal axis of the tubular member, means for forcibly extending one of the poles along the longitudinal axis of the tubular member whereby the apparatus may be frictionally supported in a vertical position between the floor and ceiling of a room, blower means mounted within the tubular member near the inlet opening and being adapted for drawing air in the inlet opening and forcing it out the outlet opening, and an air deflector at one end of the tubular member for directing the air toward the outlet opening. A differential thermostatic control circuit may be included for energizing the blower motor in response to a predetermined temperature differential between the inlet and outlet openings of the tubular member. In the preferred embodiment, the control circuit includes thermistors located in the tubular member respectively adjacent the inlet and outlet openings.

It is an object of the present invention to provide an air circulation apparatus which draws cooler air from the floor area upwardly toward the ceiling whereupon warmer air in the ceiling area is forced downwardly thereby achieving more uniform temperature conditions throughout the room.

Another object of the present invention is to provide an air circulation apparatus which is unobstrusive and occupies very little floor space.

A further object of the present invention is to provide an air circulation apparatus which is capable of being moved from one location to another as conditions warrant.

A still further object of the present invention is to provide an air circulation apparatus which is frictionally supported between the floor and ceiling thereby resisting tipping.

Yet another object of the present invention is to provide an air circulation apparatus which is portable, lightweight and inexpensive to produce.

Still another object of the present invention is to provide an air circulation apparatus which includes a differential thermostatic control.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
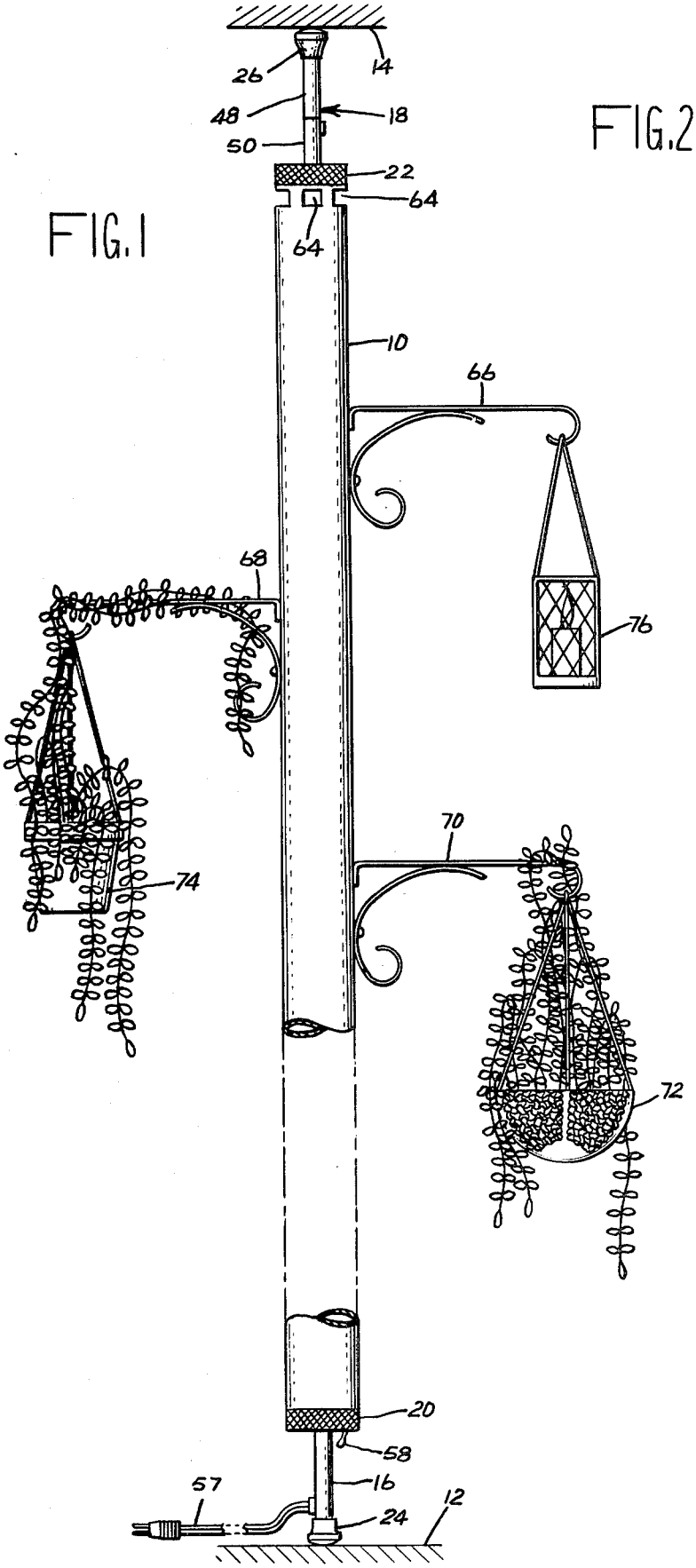
FIG. 1 is an elevational view of the invention.
Figure 2:
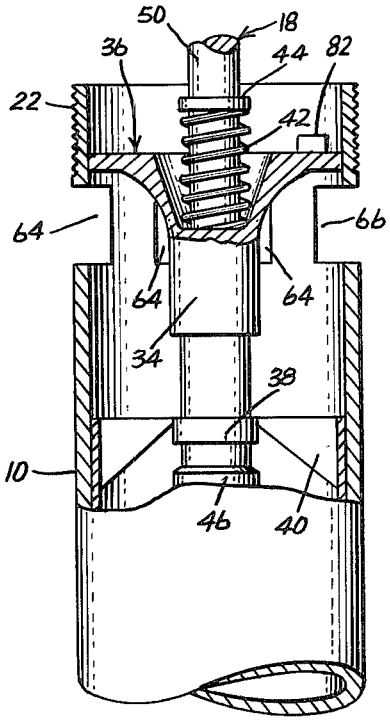
FIG. 2 is an enlarged sectional view, shown partially in elevation, of the upper portion of the apparatus.
Figure 3:
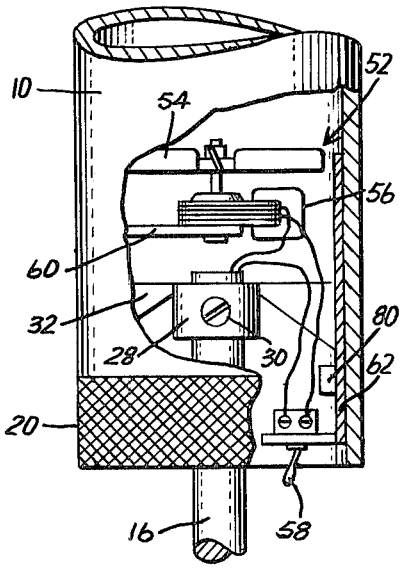
FIG. 3 is an enlarged elevation of the lower portion of apparatus, in which part of the tubular member has been broken away to illustrate the details of construction.

Referring now to FIGS. 1 through 3 of the drawings, the apparatus includes vertical tubular member 10 which may be made of rolled sheet steel, extruded plastic, or any other material which is sufficiently rigid to enable member 10 to be self-supporting. Tubular member 10 is supported between floor 12 and ceiling 14 by means of poles 16 and 18 which extend out of the opposite ends 20, 22 of member 10, along the longitudinal axis thereof. Poles 16 and 18 are provided on their distal ends with resilient plastic or rubber end caps 24 and 26 which are adapted frictionally to engage floor 12 and ceiling 14, respectively, and prevent the apparatus from tipping.

Lower pole 16 is received within cylindrical collar 28 and is locked therein by means of set screw 30. Collar 28 is fixedly supported within tubular member 10 by pole brace 32 which is welded or otherwise secured to tubular member 10.

Upper pole 18 is slidably received within the collar portion 34 of air deflector 36 and within the collar 38 of upper pole brace 40. Air deflector 36 and pole brace 40 are fixedly secured to tubular member 10, as by welding. Coil spring 42 is positioned around pole 18 and engaged on one end by collar portion 34 of deflector 36 and on the other end by retainer ring 44 fixedly secured to pole 18. Spring 42 is compressed so that it urges pole 18 upwardly against ceiling 14. Retaining ring 46 limits the upward movement of pole 18. If desired, pole 18 may comprise a plurality of sections, such as sections 48 and 50 which may be connected together to accomodate various ceiling heights.

Blower 52 is mounted within the lower portion of tubular member 10 and comprises fan blades 54, electric motor 56, power cord 57 and on-off switch 58. Motor 56 is supported on motor mounting bracket 60 and switch 58 is supported on an L-shaped extension 62 of lower pole brace 32. Lower end 20 of tubular member 10 is open as shown in FIG. 3 and serves as the intake for blower 52.

Upper end 22 of tubular member 10 is provided with a plurality of outlet openings 64 arranged in a circumferential fashion around deflector 36. Because of the generally conical shape of deflector 36, the column of vertically moving air produced by blower 52 will be deflected outwardly through outlet openings 64 in radial directions with respect to the longitudinal axis of the apparatus.

A plurality of decorative brackets 66, 68 and 70 may be mounted on tubular member 10 for supporting such items as hanging flower pots 72 and 74 and decorative candle 76.

When blower 52 is activated by turning switch 58 to the ON position, cooler air from the area near floor 12 will be drawn upwardly through tubular member 10 until it impinges on deflector 36 and is directed out through outlet opening 64. The cool air will in turn force the warm air near ceiling 14 downwardly thereby maintaining even temperature conditions throughout the room.

Figure 4:
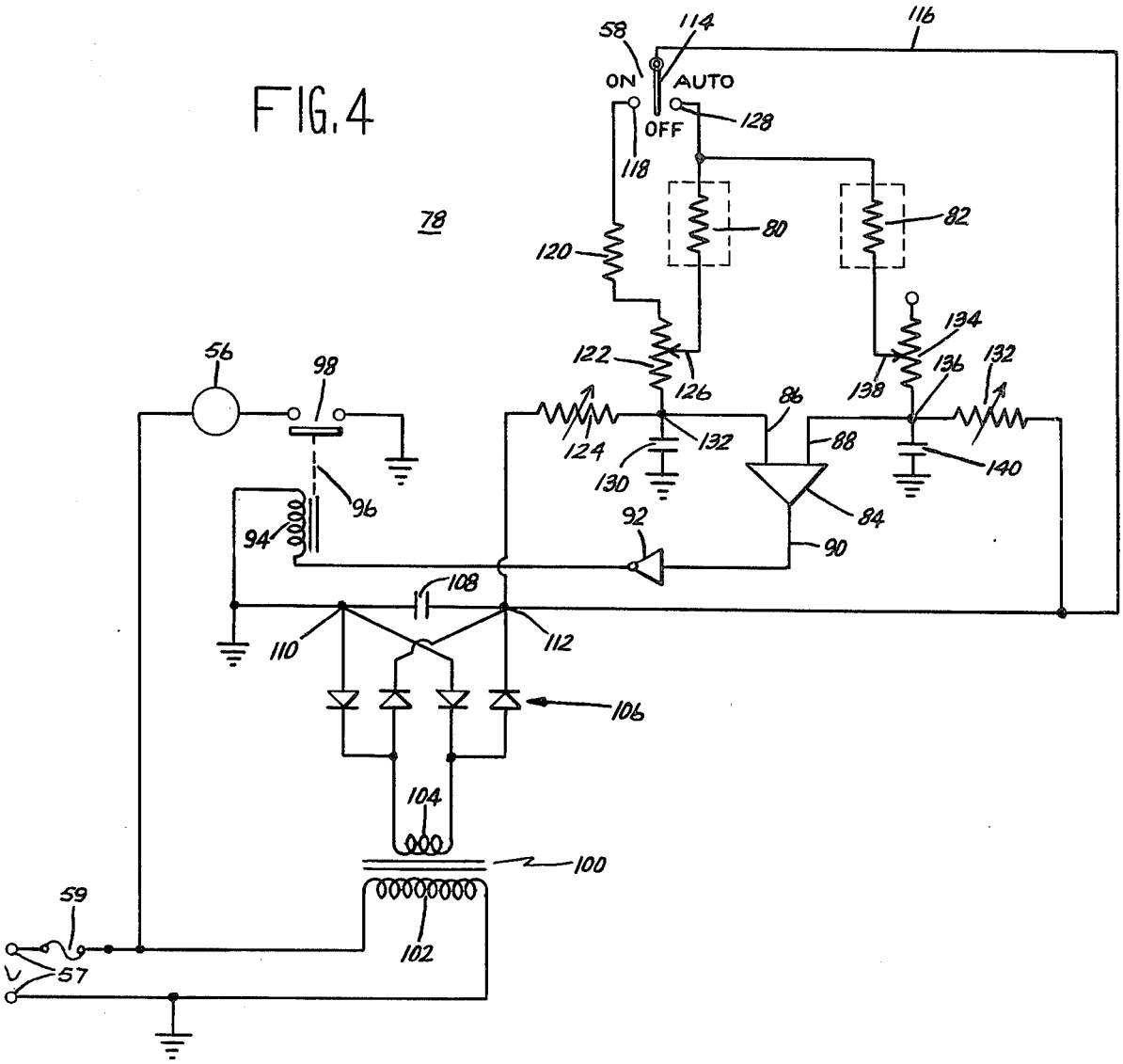
FIG. 4 is a schematic illustration of the differential thermostatic control circuit used with the apparatus of the invention.

Referring now to FIG. 4 of the drawings, a differential thermostatic control circuit is shown, generally indicated at 78, for energizing motor 56, which may be a conventional shaded pole motor or a series commutator motor. Conventional thermistors 80, 82 are respectively mounted adjacent lower and upper ends 20, 22 of tubular member 10 (FIGS. 2 and 3) respectively to sense the temperature adjacent floor 12 and ceiling 14.

Conventional solid state voltage comparator 84 has inputs 86, 88 and output 90. So long as the voltages appearing on inputs 86, 88 of comparator 84 are equal, a "one" level signal appears at output 90 which is inverted to a "zero" by inverter 92 coupled between comparator output 90 and operating coil 94 of motor relay 96. Contacts 98 of relay 96 connect motor 56 across alternating current line 57 having fuze 59 therein.

Transformer 100 has its primary winding 102 coupled across line 57 and its low voltage secondary winding 104 coupled across the input to diode bridge rectifier 106. Filter capacitor 108 is coupled across output terminals 110, 112 of rectifier bridge 106, terminal 110 being connected to ground, as shown. Output terminal 112 is coupled to movable element 114 of three-position switch 58' by line 116. "ON" contact 118 of switch 58' is coupled to output terminal 112 by resistor 120, balance adjustment potentiometer 122 and fine adjustment rheostat 124. Thermistor 80 is coupled between movable element 126 of potentiometer 122 and "AUTO" contact 128 of switch 58'. Input 86 of comparator 86 is coupled to point 132 between rheostat 124 and potentiometer 122. Capacitor 130 couples point 132 to ground, as shown.

Fine adjustment rheostat 132 couples balance adjustment potentiometer 134 to output terminal 112 of rectifier bridge 106. Movable element 138 of potentiometer 134 and thermistor 82 are coupled to "AUTO" contact 128 of switch 58'. Point 136 between rheostat 132 and potentiometer 134 is coupled to input 88 of comparator 84, and to ground by capacitor 140.

In operation with switch 58' on "AUTO", when either thermistor 80, 82 changes its resistance due to sensing a temperature change, a voltage differential will appear across inputs 86, 88 of comparator 84 resulting in a "zero" level signal in output 90 which is inverted to a "one" level signal by inverter 92 thus energizing coil 94 of relay 96 to close contacts 98 and energize blower motor 56, thus causing the apparatus to circulate air to equalize the temperature difference. When the temperature difference disappears, the output of comparator 84 returns to its idle or "one" level state, thus de-energizing blower motor 56.

Balance adjustment potentiometers 122, 134 control the sensing temperatures of thermistors 80, 82, i.e., select a predetermined temperature differential at which comparator 84 is actuated to energize blower motor 56. Fine adjustment controls 124, 132 with capacitors 130, 140 respectively form time constant circuits to eliminate small, insignificant changes in voltage from thermistors 80, 82.

While there have been described above the principles of this invention in connection with specific apparatus, it is to be clearly understood that this description is made only by way of example and not as a limitation to the scope of the invention.

What is claimed is:

1. Air circulation apparatus comprising:

an elongated tubular member having opposite ends with an air inlet opening in one end and an air outlet opening in the other end thereof, said member having a longitudinal axis, a floor pole secured to said tubular member at said one end thereof, said pole having a distal end to which is attached a resilient cap adapted frictionally to engage a flat surface, a ceiling pole secured to said tubular member at said other end thereof, said ceiling pole having a distal end to which is attached a second resilient cap adapted frictionally to engage a flat surface, at least one of said poles being extensibly connected to said tubular member for rectilinear movement along a direction generally collinear with the longitudinal axis of said tubular member, means for forcibly extending said one pole along said direction, whereby said apparatus may be frictionally supported in a vertical position between the floor and ceiling of a room, blower means mounted within said tubular member adjacent said inlet opening for drawing air in said inlet opening and forcing it out said outlet opening, and an air deflector at said other end of said tubular member directed toward said outlet opening.

2. The apparatus of claim 1 wherein said one pole is slidably received in said tubular member and said means for extending comprises a spring.

3. The apparatus of claim 2 including means for adjusting the length of said one pole.

4. The apparatus of claim 1 including a plurality of said outlet openings circumferentially spaced around said other end of said tubular member and wherein said air deflector is generally conical in shape and is positioned completely within said tubular member centrally of said outlet openings.

5. The apparatus of claim 4 wherein said ceiling pole is slidably received in said air deflector, and said means for extending comprises a spring around said ceiling pole compressed between a stop on said ceiling pole and said deflector.

6. The apparatus of claim 1 including a plurality of decorative brackets mounted on said tubular member, said brackets being adapted to support hanging objects.

7. The apparatus of claim 1 wherein said blower means includes a motor, and further comprising first and second temperature sensing devices in said tubular member respectively adjacent said inlet and outlet openings, and circuit means coupling said devices to said motor for energizing the same in response to a predetermined temperature differential between said inlet and outlet openings.

8. The apparatus of claim 7 wherein said devices are thermistors, said circuit means including voltage comparator means having inputs coupled to said thermistors and an output, and relay means coupled to said comparator output for energizing said motor in response thereto.

* * * * *